US005725832A

United States Patent [19]

Gundelsheimer

[11] Patent Number: 5,725,832

[45] Date of Patent: Mar. 10, 1998

[54] LABORATORY TEST TUBES FOR THE DOSING OF LIQUIDS

[76] Inventor: Peter Gundelsheimer, Goldgraben 34, D-67806 Rockenhausen, Germany

[21] Appl. No.: 628,232

[22] Filed: Apr. 4, 1996

Related U.S. Application Data

[63] Continuation of Ser. No. 307,569, filed as PCT/EP93/00615, Mar. 16, 1993 published as WO93/18858, Sep. 30, 1993, abandoned.

[30] Foreign Application Priority Data

Mar. 25, 1992 [DE] Germany ..... 9203973 U
Dec. 22, 1992 [DE] Germany ..... 42 43 478.5

[51] Int. Cl.[6] ..... B01L 3/14

[52] U.S. Cl. ..... 422/102; 422/72; 422/99; 422/100; 422/101; 422/104; 128/760; 128/762; 604/403

[58] Field of Search ..... 422/72, 99, 100, 422/101, 102, 104; 215/31; 128/760, 762; 604/403, 404; 141/88

[56] References Cited

U.S. PATENT DOCUMENTS

| | | | |
|---|---|---|---|
| 3,481,712 | 12/1969 | Bernstein et al. | 422/102 |
| 3,976,579 | 8/1976 | Bennett | 210/516 |
| 4,244,694 | 1/1981 | Farina et al. | 422/72 X |
| 4,256,154 | 3/1981 | Black | 141/98 |
| 4,435,293 | 3/1984 | Graham et al. | 210/772 |
| 4,486,315 | 12/1984 | Teipel | 210/772 |
| 4,606,470 | 8/1986 | Barlics | 215/232 |
| 4,675,159 | 6/1987 | Al-Sioufi | 422/36 |
| 4,762,009 | 8/1988 | Scrudto | 73/863.52 |
| 4,967,763 | 11/1990 | Nugent et al. | 128/763 |
| 5,084,240 | 1/1992 | Babson | 422/72 |
| 5,098,845 | 3/1992 | Babson | 436/45 |
| 5,137,031 | 8/1992 | Guirguis | 128/771 |
| 5,167,929 | 12/1992 | Korf et al. | 422/102 |
| 5,244,635 | 9/1993 | Rabson et al. | 422/72 |
| 5,318,748 | 6/1994 | Babson et al. | 422/72 |

*Primary Examiner*—Harold Y. Pyon
*Attorney, Agent, or Firm*—Foley & Lardner

[57] ABSTRACT

The present invention concerns laboratory test tubes for the dosing of liquids. Connected to the opening of the test tube is an inner tube, which is shorter than the test tube. Between the test tube and the inner tube is an intermediate space of a constant retention volume. The intermediate space preferably has a width of between 0.5 mm and 1 mm. Also disclosed is a method of using the laboratory test tubes of the present invention for the resuspension of sediments obtained by centrifuging.

13 Claims, 3 Drawing Sheets

FIG.IE
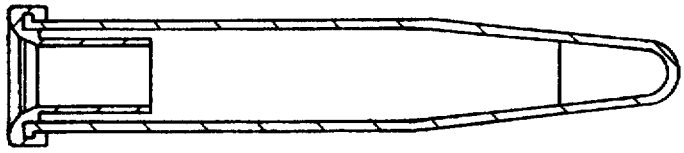
FIG.ID
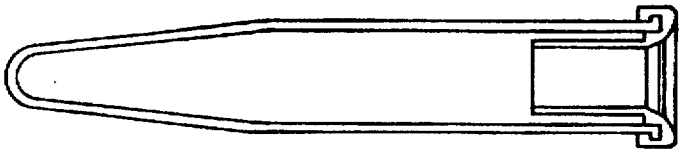
FIG.IC
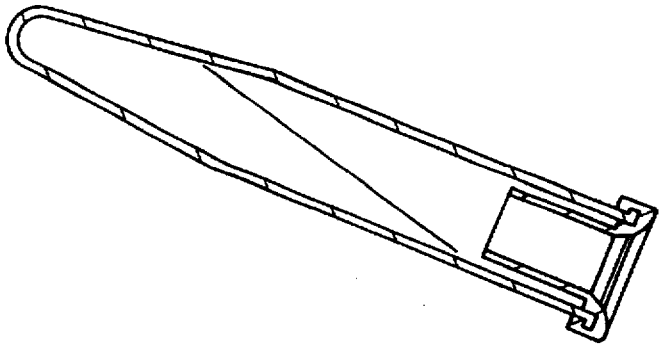
FIG.IB
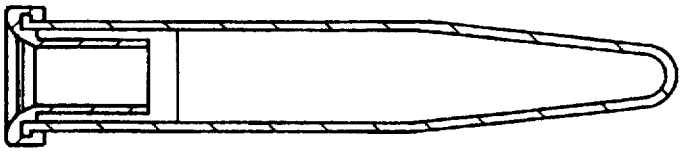
FIG.IA
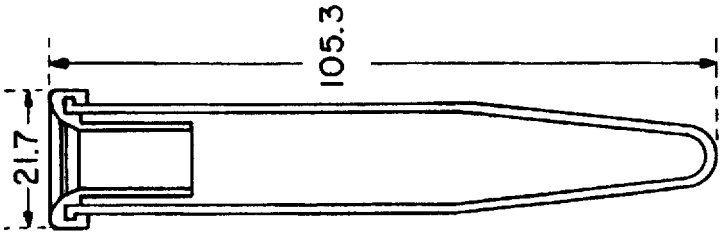

LABORATORY TEST TUBES FOR THE DOSING OF LIQUIDS

This application is a continuation of application Ser. No. 08/307,569, filed Sep. 21, 1994, now abandoned, which is a 371 of PCT/EP93/00615, filed Mar. 16, 1993, published as WO93/18858, Sep. 30, 1993, which claim priority of Federal Republic of Germany application No. G9203973.1, filed Mar. 25, 1992, and Federal Republic of Germany application No. P4243478.5, filed Dec. 22, 1992.

BACKGROUND OF THE INVENTION

1. Field of the Invention

The present invention concerns a laboratory test tube for the dosing of liquids with which it is possible to retain in the laboratory test tube a predetermined amount of a liquid simply, pleasant to use and contamination-safe and to remove the remainder. With this device, it is, on the one hand, possible to concentrate sedimentable solid materials and, on the other hand, to dilute dissolved materials.

In the case of the investigation of sedimentable component materials of a liquid, for example urine or blood, a definite amount of the suspension is filled into a centrifuge tube, the solid material collected by centrifuging on the bottom of the tube, the supernatant solution poured off and the sediment resuspended in a definite, normally substantially smaller amount of liquid for the further investigation in order to obtain a concentrated sediment. For the taking-up again, there is thereby normally used the same liquid which had previously been poured off. For this purpose, definite amount must be pipetted off and again returned to the laboratory test tube. Apart from the work which this causes, there is also the danger of a contamination due to the handling of liquids which possibly contain pathogenic agents.

On the other hand, it is frequently not possible to investigate solutions directly because the concentration of the component materials lies too high for the methods of investigation in order to obtain differentiable results. For this case, it is necessary to dilute the solutions which again is carried out via a series of pipetting steps. For the simplification of this dilution, it was, therefore, suggested in DE-G 19 72 298 to provide on the bottom of a laboratory test tube a narrow pocket hole in which, by capillary forces, in the case of emptying a comparatively large amount of a low defined amount of liquid collects which, in the case of again filling with dilution agent, distributes uniformly in the dilution agent due to the turbulences and concentration gradients brought about in the case of the filling. By means of appropriate markings of the laboratory test tube, definite dilution agent additions and thus dilution series can be produced easily and without additional adjuvants. However, this process has the disadvantages that, on the one hand, by means of the capillary forces-only very small amounts of liquid can be held back so that either the dilution factor is very great or the amount of solution obtained after the dilution is relatively small and, on the other hand, the production of reproducable capillary spaces requires a considerable technical manufacturing expense so that it is not possible to produce such test tubes as disposable articles and, in the case of cleaning, the danger of a contamination again occurs. Furthermore, such a system is not suitable for the concentration of sediments since a solid material cannot reproducably again be dissolved&d out of the capillary system.

Therefore, the task exists to provide a simple device which, on the one hand, retains a definite amount of a liquid in a laboratory test tube and, on the other hand, permits a complete mixing up with sediment remaining behind or dilution solution.

This task is solved by the features of the main claim and promoted by the features of the subsidiary claims.

2. Description of the Prior Art

U.S. Pat. No. 3,748,099 describes a laboratory test tube with level markings and closure stopper which closes tightly around the test tube inwardly and outwardly. In this is slidably inserted a canula 23 through which a definite amount of liquid can be pressed out. The illustrated device serves in this regard also more as a pipette with which definite amounts of solutions can be discharged and not as laboratory test tube for the dosing of liquids which are retained in the test tube whereas an excess is removed.

GB-A 20 82 091 describes a test tube which is open on both sides, whereby, by means of an inserted stopper or by means of a corresponding shaping of the test tube itself, a narrow inner canal (40) is formed through which the liquids can be introduced or withdrawn and in the outer region of which the solid material collects in the case of centrifuging. According to manner of proceeding, the canal must be correspondingly very narrow since otherwise, in the case of centrifuging, a noteworthy amount of the solid material is present within the canal and would correspondingly be lost.

U.S. Pat. No. 3,481,712 describes a centrifuge glass with a tapered lower end (25) in which the sediment is retained, whereas the supernatant liquid can be removed. In its plane upper part, the closure cap (21) is formed as microscope glass so that subsequently, as illustrated in FIG. 8, the sediment can be poured out on to the plate, whereby an excess runs into the outer hollow space (35). A measurement is not connected therewith. An alternative embodiment is described in FIGS. 9 and 10, whereby the sediment deposits in the intermediate space of the cap from which, after removal of the liquid, it can again be transferred to a microscope plate by gentle shaking, as is illustrated in FIG. 10. Also in the case of this manner of proceeding, a constant retention volume for liquid, which is again to be passed back into the laboratory test tube and there mixed, is not given.

FR-A 2,122,187 describes an ampoule with differently wide parts so that an easy measurement of the liquid standing in these parts is possible. Furthermore, in FIG. 10, a canula is also placed in the upper opening through which it is possible to suck a certain liquid volume into the ampoule. The inwardly protruding tube (56) thereby permits, in the case of multiple withdrawal procedure, air again to be expelled at intervals or again to force out excess liquid.

SUMMARY OF THE INVENTION

According to the invention, into the laboratory test tube, which possesses a cylinder-shaped opening, is inserted an inner tube, the outer diameter of which is 0.5 to 2 mm smaller than the inner diameter of the cylindrical opening so that a definite intermediate space is formed which, depending upon the length of the inserted inner tube, defines a retention space. In the case of the slow pouring out of the content of the laboratory test tube, this intermediate space fills with the outflowing liquid so that only the excess runs off and, in the case of the return of the test tube into the vertical position, completely runs out from this intermediate space. Therefore, in order to make possible a complete return, the intermediate space must not be so narrow that capillary forces firmly retain a part of the liquid in the case of putting back, whereby there is given the lower limit of about 0.5–1 mm. However, on the other hand, the gap should also not be too wide since otherwise, for a particular retention volume, the length of the inner tube becomes correspondingly smaller and thus additional errors could occur in the case of the emptying. Furthermore, in the case of inherently narrow laboratory test tubes, the inner opening of the inserted inner tube serving in the case of filling and emptying becomes correspondingly small which again can give rise to handling disadvantages. Therefore, it is advantageous to widen the opening in the form of a funnel or, if desired, also to provide with a pouring-out nozzle.

The secure connection between laboratory test tube and inner tube is preferably brought about in that the inner tube has a corresponding thickening on its upper part which can be pressed into the opening of the laboratory test tube with a certain pressing force. A formed-on collar can be provided in order to prevent a too deep pressing into the test tube. Alternatively, it is possible to form the collar externally gripping round the test tube and to hold this with a pressing force or to provide with a thread by means of which it can be screwed on to a corresponding counterthread of the laboratory test tube. The thickening in the interior can then be omitted.

Laboratory test tubes today consist practically exclusively of glass or synthetic material and can be produced with very small tolerances. The inner tubes used according to the invention are preferably also made from synthetic material which, on the one hand, has sufficient elasticity in order to make a tight connection with the laboratory test tube and, on the other hand, is so inexpensive that the whole device can be made as disposable article and, therefore, can be discarded after use. If laboratory test tube and inner tube are made from the same synthetic material, there is given additionally the advantageous possibility of a recycling of the synthetic material without the two parts again having to be separated.

The present invention is especially intended for the commercially-available centrifuge glasses which have a content of about 15 ml and are provided e.g. with markings for 3, 5 and 10 ml. In the case of a length of about 10 cm, such tubes have an inner diameter of 14 mm. An inserted inner tube with 12 mm outer diameter and a length of 15 mm has a retention volume of 1 $cm^3$. Therefore, with use of the given markings, dilution or concentration ratios of 1:3, 1:5 or 1:10 can very easily be adjusted without additional measurement aids.

Although the device has itself been developed for the concentration of sediments in centrifuge glasses, the same device can naturally also be used for vessels of other shape so Long as these possess an opening which fits together precisely with the device. For example, the 10 ml syringe is usually made from synthetic material which, for the centrifuging, possesses a shortenable piston rod, can also be provided after the centrifuging with such an inner tube and, in this way, not only a definite amount of serum but also a definite amount of the sediment again resuspended in the serum are obtained which is available for the further investigation. Also other laboratory vessels, such as Erlenmeyer flasks and round flasks etc., which possess a cylindrical opening with suitable diameter can be converted into a measurement vessel by application of an appropriate retention device. Other forms of use are conceivable without, however, here being described in detail.

BRIEF DESCRIPTION OF THE DRAWINGS

The invention is explained in more detail in the accompanying Figures without, however it being limited thereto, wherein:

FIGS. 1*a*–1*e* and 2 show a first embodiment according to the invention;

FIG. 2 shows a second embodiment according to the invention;

DETAILED DESCRIPTION

FIGS. 1*a*–1*e* show a centrifuge glass with inserted retention system, whereby FIG. 1*a* is a section through the system, FIG. 1*b* shows the filled test tube, FIG. 1*c* shows the tiltedly positioned test tube with the liquid running out, FIG. 1*d* shows the test tube in the emptied state with the residual, volume in the retention device and FIG. 1*e* shows the turned back test tube. With the residual volume on the sediment.

Figure 2:
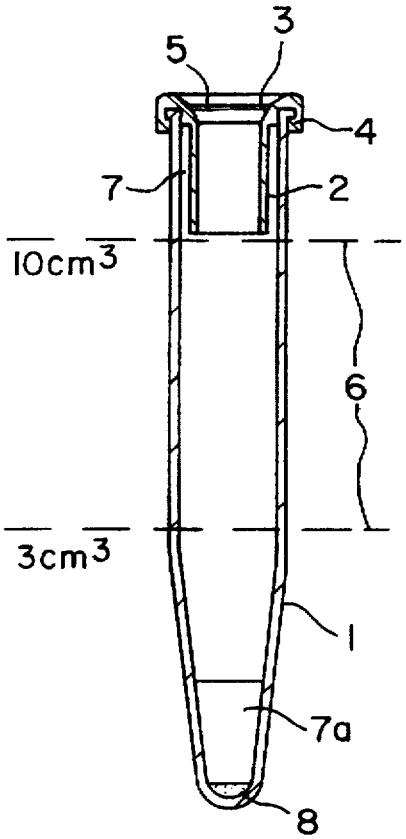

FIG. 2 is an enlarged illustration of FIG. 1*e* with the laboratory test tube 1, the inserted inner tube 2 which has a thickening 3 which fits into the inner diameter of the laboratory test tube 1 and a collar which outwardly encompasses the laboratory test tube 1. Into the thickening 3 and the collar 4 is incorporated a funnel-shaped widening 5. The intermediate space between the inner tube 2 and the laboratory test tube 1 defines the retention volume 7 which corresponds to the volume, 7*a* in the repositioned state. A sediment 8 is indicated on the bottom of the test tube 2. Furthermore, level markings 6 are given which correspond e.g. to a filling amount of 3 $cm^3$.

Figure 3:
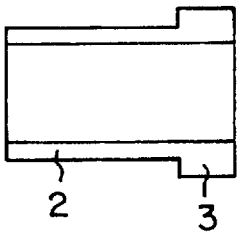
FIG. 3 shows a third embodiment according to the invention.

FIG. 3 shows a simplified embodimental form of the inner tube which merely consists of the inner tube 2 and the formed-on thickening 3.

Figure 4:
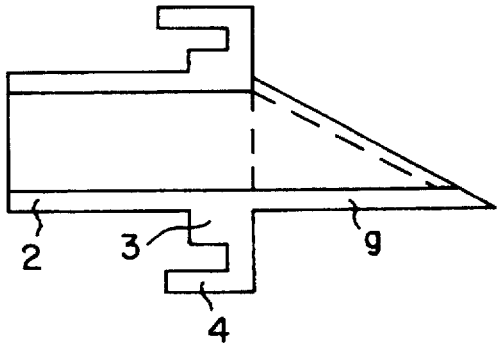
FIG. 4 shows a fourth embodiment according to the invention.

FIG. 4 shows a device which, apart from the inner tube 2, the thickening 3 and the collar 4, also has a formed-on pouring nozzle 9.

Figure 5:
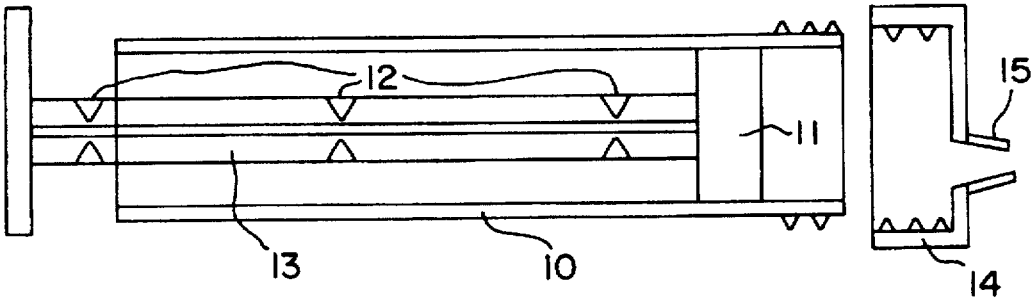
FIGS. 5 and 5*a* show, respectively, a conventional syringe and a syringe according to the invention.
Figure 5A:
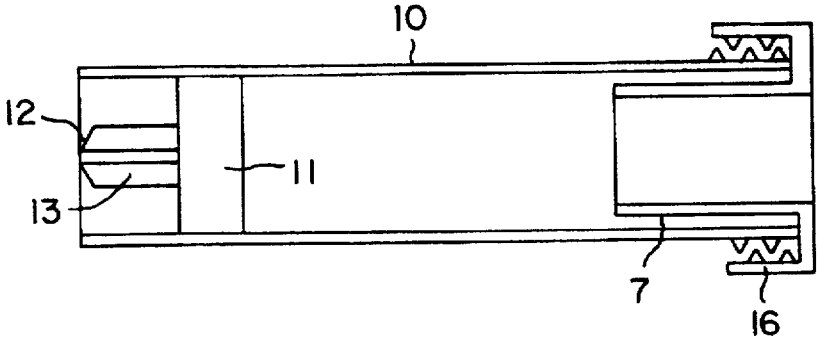

FIG. 5 shows a commercially available syringe with the outer tube 10, the piston 11, the hand grip 13 provided with several breakage indentations 12 as well as a screwable closure cap 14 on which is formed the canula connection 15. FIG. 5*a* shows the same syringe with the attachment according to the invention which, via a screw connection 16, is screwed on to the syringe. The hand grip 13 is broken off at the first breakage indentation 12.

I claim:

1. A dosing laboratory test tube comprising:

an outer tube of a first length, said outer tube having an open first end and a closed second end;

an inner tube having a second length which is shorter than said first length, said inner tube having an open outer end and an opening intermediate said open first end and said closed second end of said outer tube, said open outer end being positioned adjacent said open first end of said outer tube when said inner tube is positioned in said outer tube; and a thickening, that is free of apertures, extending from said inner tube to an inner surface of said outer tube so that, when said inner tube and said thickening are positioned in said outer tube, an intermediate space of constant retention volume is formed between said outer tube and said inner tube, the intermediate space having a width of at least 0.5 mm to a maximum of 1.0 mm, said thickening having an outer diameter corresponding to an inner diameter of said outer tube to fasten said inner tube and said outer tube together in a press fit.

2. A dosing laboratory test tube according to claim 1, wherein said intermediate space has a width between 0.5 mm and 1 mm.

3. A method of using a dosing laboratory test tube according to claim 1 for the resuspension of sediments obtained by centrifuging.

4. A dosing laboratory test tube according to claim 1, wherein said thickening is integrally formed with said inner tube.

5. A dosing laboratory test tube according to claim 1, wherein said thickening is positioned on said outer surface of said inner tube adjacent said open outer end of said inner tube.

6. A dosing laboratory test tube according to claim 1, wherein said outer tube and said inner tube comprise recyclable synthetic material.

7. A method of using the dosing laboratory test tube of claim 6 for the resuspension of sediments obtained by centrifuging.

8. A dosing laboratory test tube according to claim 6 and further comprising a collar formed on said open outer end of said inner tube, said collar dimensioned to encompass said open first end of said outer tube, said thickening being positioned on said outer surface of said inner tube adjacent said open outer end of said inner tube, said collar and said thickening comprising a funnel-shaped filling opening.

9. A dosing laboratory test tube according to claim 1 and further comprising a collar formed on said open outer end of said inner tube, said collar adapted to encompass said open first end of said outer tube.

10. A dosing laboratory test tube according to claim 9, wherein said thickening is positioned on said outer surface of said inner tube adjacent said open outer end of said inner tube, and said thickening and said collar comprise a funnel-shaped filling opening.

11. A dosing laboratory test tube according to claim 9, wherein said thickening is positioned on said outer surface of said inner tube adjacent said open outer end of said inner tube, and said collar is integrally formed with said thickening.

12. A dosing laboratory test tube comprising:

an outer tube of a first length, said outer tube having an open first end and a closed second end;

an inner tube having a second length which is shorter than said first length, said inner tube having an open outer end and an opening intermediate said open first end and said closed second end of said outer tube, said open outer end being positioned adjacent said open first end of said outer tube when said inner tube is positioned in said outer tube; and a collar extending outwardly from said open outer end of said inner tube, said collar dimensioned to encompass said open first end of said outer tube so that, when said inner tube and is positioned in said outer tube and said collar is mounted to said open first end of said outer tube, an intermediate space of constant retention volume is formed between said outer tube and said inner tube, the intermediate space having a width of at least 0.5 mm to a maximum of 1.0 mm.

13. A dosing laboratory test tube according to claim 12, wherein an outer surface of said outer tube has threads, and said collar has threads for threaded engagement with said threads of said outer tube.

* * * * *